United States Patent [19]

Chaygneaud-Dupuy

[11] Patent Number: 4,964,563

[45] Date of Patent: Oct. 23, 1990

[54] COVERING FOILS FOR WINDOWS AND PACKING BOXES PROVIDED WITH SUCH WINDOWS

[76] Inventor: Francois Chaygneaud-Dupuy, Les Grands-Moulins Bouex, Dignac, France, 16410

[21] Appl. No.: 362,767

[22] Filed: Jun. 7, 1989

[30] Foreign Application Priority Data

Jun. 10, 1988 [FR] France ..... 88 07792

[51] Int. Cl.[5] ..... B65D 25/54

[52] U.S. Cl. ..... 229/162; 206/45.31; 428/192

[58] Field of Search ..... 229/162; 220/82 R; 206/45.31; 222/156, 157; 428/156, 192

[56] References Cited

U.S. PATENT DOCUMENTS

| | | | |
|---|---|---|---|
| 3,273,702 | 9/1966 | Palmer | 206/45.31 |
| 3,301,143 | 1/1967 | Palmer | 229/162 |
| 4,545,483 | 10/1985 | Shiba et al. | 220/82 R |
| 4,664,648 | 5/1987 | Dupuy | 206/45.31 |
| 4,733,916 | 3/1988 | Seufert | 229/162 |
| 4,817,347 | 4/1989 | Hand et al. | 428/192 |
| 4,826,004 | 5/1989 | Dupuy | 229/162 |

FOREIGN PATENT DOCUMENTS

| | | | |
|---|---|---|---|
| 713419 | 7/1965 | Canada | 206/45.31 |
| 2599335 | 12/1987 | France | 229/162 |
| 2188614 | 10/1987 | United Kingdom | 220/82 R |

*Primary Examiner*—Gary E. Wlkins

*Attorney, Agent, or Firm*—Lerner, David, Littenberg, Krumholz & Mentlik

[57] ABSTRACT

This invention is related to a manufacturing process of covering foils of packing boxes extending over at least one edge of the box. The process comprises the steps of cutting slots in a film (3) of rigid transparent material, of glueing a film (4) of flexible transparent plastic material to the prepared film, and of cutting covering foils from the resulting composite material. This invention is also related to the foils made in this way and to the packing boxes provided with such covering foils for the windows.

9 Claims, 2 Drawing Sheets

COVERING FOILS FOR WINDOWS AND PACKING BOXES PROVIDED WITH SUCH WINDOWS

Figure 1:
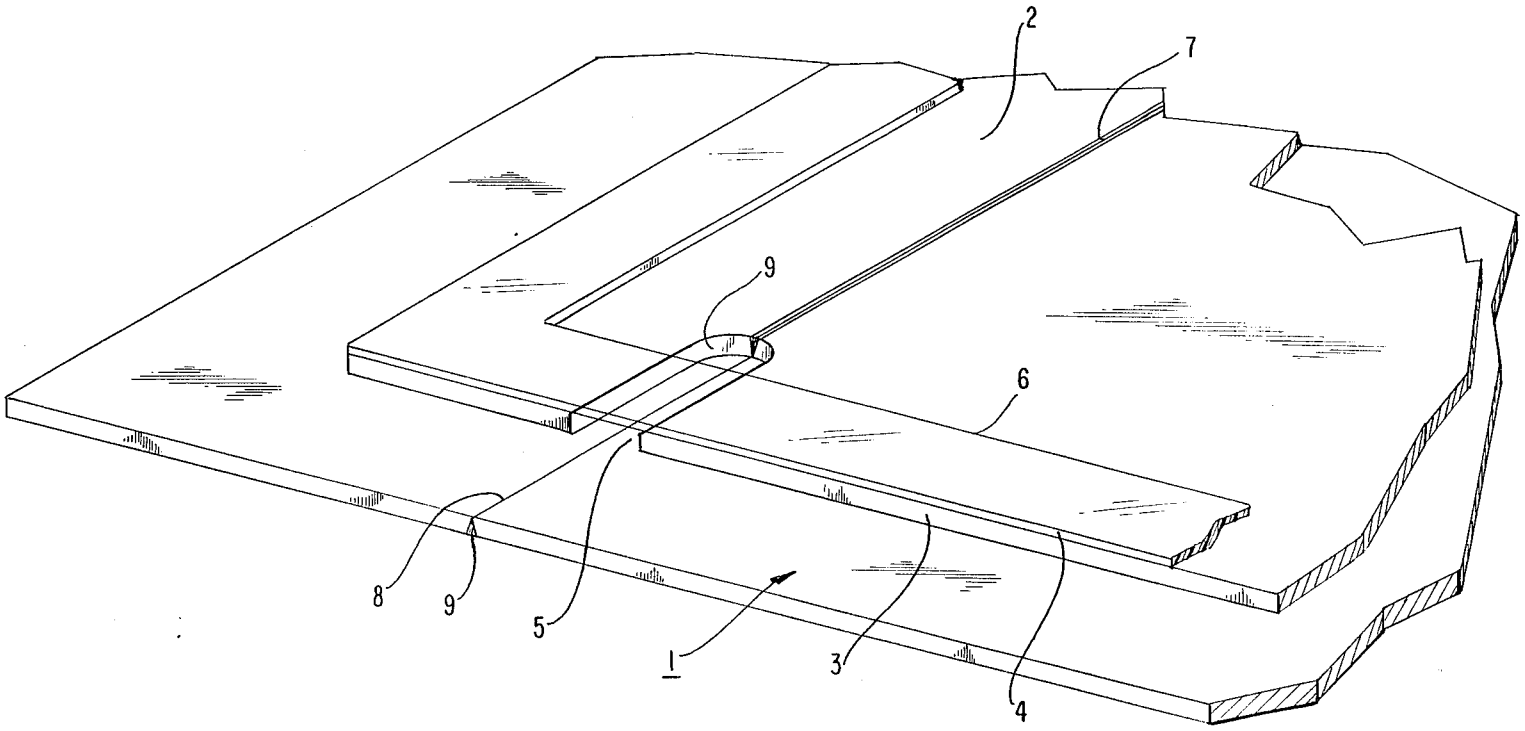

This invention is related to a manufacturing process of covering foils for the windows of packing boxes and to the windows obtained in this way as well as to the boxes provided with such boxes.

In the state of the art, several types of display and packing boxes are known, they are provided with windows closed by transparent foils. Such boxes permit an effective display of their contents.

More particularly, the applicant has filed an application for a French patent, registered under No. 80 26 305, regarding a display box having an opening over one edge at least, said opening being closed by a rigid and transparent plastic material foil. The window of transparent plastic material has cut-ups at the ends of the grooves associated to the edges of the box, so that the foil edges do not cooperate with the folding flanges of the box cardboard blank.

Besides, the applicant has filed an additional application under No. 81 13 025 regarding a manufacturing process of boxes of this type, comprising the cutting of a blank that forms the box complete with an opening, the positioning of a transparent plastic material foil over the opening, said foil being larger than said opening, and the grooving of the foil in order to form the beginning of folds.

The boxes made in this way feature a greater rigidity than the boxes of prior art and having a flexible plastic material foil covering the window.

More particularly, they are remarkable in that there is no flange building itself beginning at the connections between the foil and the cardboard blank on the edge, owing to the provision of slots extending beyond the border of the window.

The presence of the slots goes against current prejudices of the manufacturers of display packing boxes, yet the slots are fairly unnoticeable so that a casual observer does not notice them.

Moreover, by reason of electrostatic charges, no dust can enter the boxes through the slots.

However, in the case of packings for food products, and, more generally, when a contact of the contents with ambient air is not desired, said slots may be undesirable.

Despite the considerable success met by the packing boxes of the applicant, it has not been possible until now to retain the advantage given by the slots, that is the absence of tear of the covering foil and of the cardboard blank, and at the same time, to provide an adequate sealing of the packing box.

This invention provides a solution to the problem by proposing a manufacturing process of a covering foil for a packing box window having both the advantageous features given by the slots and a relative sealing of the box.

This invention refers more particularly to a manufacturing process of covering foils for packing box windows extending on at least one edge of said box that comprises the steps of cutting out slots in a film of clear rigid plastic material, of glueing a film of clear flexible plastic material having no slots onto the above prepared film, of cutting covering foils from the composite material obtained, with grooving of the folding lines at the same step.

Through this process it is possible to manufacture at the same time, a great number of covering foils by means of automatic machines, and the resulting covering foils can subsequently placed on the cardboard blank by the conventional technique.

According to a preferred embodiment, the film of rigid plastic material and the film of flexible plastic material are joined by means of an adhesive having no adherence properties in normal storage and service conditions of the packings.

This prevents the adhesive film left exposed by the rigid plastic material film in the slot regions to attract and trap solid particles such as dust.

The adhesives giving satisfactory results are, for example, the so-called "hot melt" glues whose tack or adhesion properties are zero or very low when cold and that are utilized and applied at temperatures much higher than ambient temperatures.

Also, the desired result can be achieved with glues that are activated by conditions not normally present: ultraviolet radiations, chemical agents, high frequency.

According to a preferred form of embodiment, the union of both rigid and flexible plastic material films is obtained by the application of a layer of adhesive on the flexible film and the resulting composite assembly is rolled by two press-cylinders that exert pressure on either side of said assembly.

Experience has taught that the best bonding between the film is achieved when the adhesive layer is applied on the flexible film. The flexible film has better capabilities to assume the shape of the possible variations in thickness of the rigid thicker film.

More particularly, this permits to prevent any refraction phenomena that occur in case of variations, however small, in the interface between both films.

This invention also relates to a covering foil for packing boxes having a window extending over at least one edge comprising a first a first transparent rigid sheet having pre-grooved grooves with at their ends slots extending beyond the line that is respective to the window edges, and a second substantially similar transparent flexible sheet having no slots, both transparent sheets being glued against each other.

A covering foil of this kind permits to obtain a foldable display packing that eliminates the risk of tearing at the connection between the clear foil and the cardboard blank while being tight enough to prevent the introduction into the box of microscopic dust particles or of fluids.

Moreover, with such covering foils, it is possible to make covering foils for foldable display packings that meet the requirements of all standards, and more particularly, food standards, by covering the rigid plastic material sheet, the quality of which is unimportant and for which the selection criteria basically are rigidity and low cost, with a flexible plastic material sheet the contact of which with the box contents is not prohibited by ruling standards.

For instance, a low-priced but prohibited by food standards vinyl polychrolide sheet can be covered by a flexible sheet of vinyldilene polychrloride.

This invention is also related to a foldable display box comprising a cardboard blank having a window over at least one edge covered by a transparent window provided with pre-grooved fold lines in alignment with the edges of the cardboard blank and having at the ends of said pre-grooved fold lines slots that extend at least up to the window edges, the rigid material sheet being covered by a flexible transparent plastic material sheet of substantially identical dimensions and having no slots.

Figure 2:
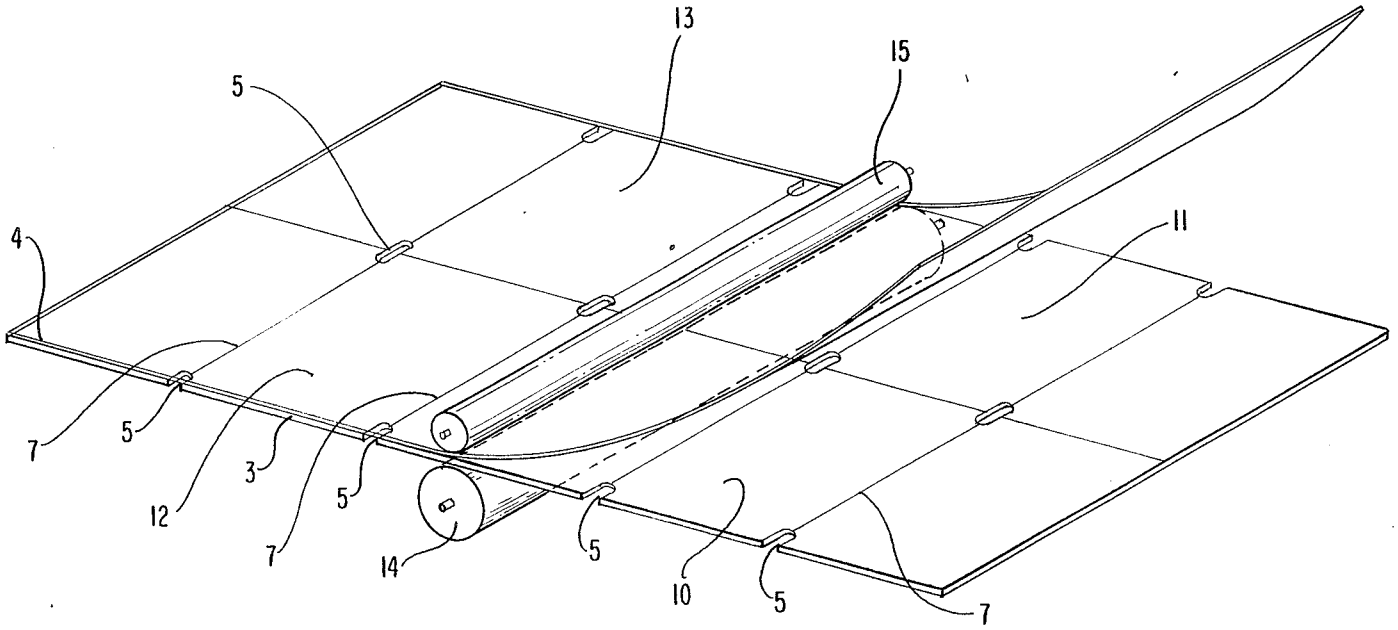

Other features and forms of embodiment will become apparent from the following description on the basis of FIG. 1 that is a perspective view of a portion of a box provided with a window according to this invention and of FIG. 2 that shows a device for implementation of the process according to this invention.

The packing box shown in FIG. 1 comprises a blank 1 of rigid or semi-rigid cardboard having a window 2.

The window 2 is covered with a transparent foil comprising a first rigid transparent plastic material sheet 3 and a second flexible transparent plastic material sheet 4. The rigid transparent plastic material sheet has a slot 5 extending at least up to the edge 6 of the window 2.

Moreover the rigid plastic material sheet 3 has a pre-grooved fold line 7 in alignment with the fold line (8) of the cardboard blank 1. The slot 5 prevents the tearing of the cardboard blank 1 when the edge is formed by folding the blank in order to construct the box.

In the region of the folding line 8 the folding causes flanges to be formed, that slightly distort the window edge, which is unimportant if the rigid sheet 3 is provided with a slot 5 at this location.

In order to prohibit the introduction of foreign substances, even fluids, through the gap left between the edge 6 of the window 2 and the edges 9 of the slot 5, the rigid transparent plastic material sheet is covered with a flexible transparent plastic material sheet.

By way of example, the sheet of rigid transparent plastic material is a PVC material with thickness ranging from 150 to 400 microns and the sheet of flexible transparent plastic material 4 is a sheet of vinylidene polichloride in thickness 10 to 30 microns.

According to another example implemented by the applicant, the sheet of flexible transparent plastic material 4 is a 12 micron thick polyester.

The adhesive used to join together the sheet of rigid transparent plastic material 3 and the sheet of flexible transparent plastic material 4 is a so-called "hot-melt" glue, the adhesive power of which is only effective at a temperature higher than 60° C.

FIG. 2 shows the principle of manufacturing of a covering sheet according to this invention.

Slots 5 are provided in a sheet 3 of rigid transparent plastic material at the locations of the intersection of pre-grooved lines 7 with the future edges of the window 2. Preferably, individual covering foils 10, 11, 12, 13 are cut out from one rigid foil 3, and placed in head-to-tail arrangement on a film of rigid transparent material of large dimensions.

The film of rigid transparent material 3 on the one hand and the pre-glued film of flexible transparent plastic material 4 on the other hand are guided between two rolls 14, 15.

The pressure from both rolls 14, 15 provides a homogenous and efficient gumming of the two transparent films. Preferably, the roll applying pressure on the side of the rigid film is made of a hard material such as metal, while the roll 15 applying pressure to the flexible film 4 is made of a flexible material such as rubber.

At the end of the process of glueing transparent films together, individual covering foils are cut from the composite material obtained in this way.

This invention is not limited to the above-described forms of embodiment but, on the contrary, encompasses all alternative forms of embodiment that may be considered.

I claim:

1. A foldable display box comprising a cardboard blank having a window with at least one edge, a rigid transparent foil for covering the window of said cardboard blank, said rigid transparent foil having a first end and a second end, at least one fold line and at least one slot coextensive with said at least one fold line and being located at one of said ends so that when said rigid transparent foil is arranged to cover the window of the cardboard blank, said at least one slot extends at least up to said edge of said window, and a foil of flexible transparent material having no slots is glued to said rigid transparent foil by a glue, both foils having substantially identical dimensions.

2. A foldable display box according to claim 1, wherein said second foil of flexible transparent material carries the glue which glues said second foil of flexible transparent material to said first rigid transparent foil, said glue being substantially non-adhesive at temperatures which are at or lower than ambient temperatures.

3. A foldable display box according to claim 2, wherein said glue is adhesive only when the temperature is above about 60° C.

4. A foldable display box according to claim 1, wherein said glue is a hot melt glue.

5. A covering foil for foldable packaging boxes having a window with at least one edge, said covering foil comprising a first rigid transparent foil for covering the window of a foldable packing box, said first rigid transparent foil having a first end and a second end, at least one fold line and at least one slot coextensive with said at least one fold line and being located at one of said ends so that when said covering foil is arranged to cover the window of the foldable packing box, said at least one slot extends beyond the edge of the window, and a second foil of flexible transparent material, said second foil of flexible transparent material being substantially the same size as said first rigid transparent foil and having no slots, said first rigid transparent foil and said second foil of flexible transparent material being glued together by a glue.

6. A covering foil for folding packing boxes according to claim 5, wherein said second foil of flexible transparent material carries the glue which glues said second foil of flexible transparent material to said first rigid transparent foil, said glue being substantially non-adhesive at temperatures which are at or lower than ambient temperatures.

7. A covering foil for foldable packing boxes according to claim 6, wherein said glue is adhesive only when the temperature is above about 60° C.

8. A covering foil for foldable packing boxes according to claim 5, wherein said glue is a hot melt glue.

9. A covering foil for foldable packaging boxes having a window with at least one edge, said covering foil comprising a first rigid transparent foil for covering the window of a foldable packing box, said first rigid transparent foil having a first end and a second end, at least one fold line and at least one slot co-extensive with said at least one fold line and being located at one of said ends so that when said covering foil is arranged to cover the window of the foldable packing box, said at least one slot extends beyond the edge of the window, and a second foil of flexible transparent material, said second foil of flexible transparent material, said second foil of flexible transparent material being glued to said first rigid transparent foil and including portions which are coincident with and completely overlap all of said at least one slots.

* * * * *

UNITED STATES PATENT AND TRADEMARK OFFICE

CERTIFICATE OF CORRECTION

PATENT NO. : 4,964,563

DATED : October 23, 1990

INVENTOR(S) : Francois Chaygneaud-Dupuy

It is certified that error appears in the above-identified patent and that said Letters Patent is hereby corrected as shown below:

Column 2, Line 38, cancel second occurrence of "a first"

Column 2, Line 61, "vinyldilene" should read --vinylidene--

Column 3, Line 19, "(8)" should read --8--

Column 3, Line 35, "polichloride" should read --polychloride--

Column 4, Line 63, cancel first occurrence of "said second foil of flexible transparent material"

Signed and Sealed this

Twelfth Day of May, 1992

*Attest:*

DOUGLAS B. COMER

*Attesting Officer*

*Acting Commissioner of Patents and Trademarks*